US005253226A

United States Patent [19]

Ganter

[11] Patent Number: 5,253,226

[45] Date of Patent: Oct. 12, 1993

[54] RADIO-CONTROLLED TIMEPIECE WITH ANTENNA COIL

[75] Inventor: Wolfgang Ganter, Schramberg, Fed. Rep. of Germany

[73] Assignee: Junghans Uhren GmbH, Schramberg, Fed. Rep. of Germany

[21] Appl. No.: 936,303

[22] Filed: Aug. 28, 1992

[30] Foreign Application Priority Data

Sep. 7, 1991 [DE] Fed. Rep. of Germany ... 9111096[U]

[51] Int. Cl.[5] ..... G04C 11/02

[52] U.S. Cl. ..... 368/47; 368/55; 368/10

[58] Field of Search ..... 368/46–61, 368/10

[56] References Cited

U.S. PATENT DOCUMENTS 4,645,357 2/1987 Allgaier et al. ..... 368/43

FOREIGN PATENT DOCUMENTS 0242717 4/1987 European Pat. Off. .
0382130 2/1990 European Pat. Off. .
8815967 11/1989 Fed. Rep. of Germany .

*Primary Examiner*—Bernard Roskoski
*Attorney, Agent, or Firm*—Burns, Doane, Swecker & Mathis

[57] ABSTRACT

A radio-controlled timepiece includes an antenna ferrite core which also serves as a base plate having recesses into which the thicker clockworks components, such as a hands mechanism are disposed. Thinner clockworks parts, such as strip conductors, circuits and optronic display modules are mounted directly to the surface of the core. Plastic inserts are affixed to the bottoms of the recesses and includes holes in which the thicker clockworks parts are mounted.

13 Claims, 1 Drawing Sheet

RADIO-CONTROLLED TIMEPIECE WITH ANTENNA COIL

BACKGROUND OF THE INVENTION

The invention concerns a radio controlled timepiece having an outer casing for containing clockworks components, including a time display, an antenna for receiving radio signals to control the time display, and a receiver connected to the antenna and to the time display.

Such a basic mechanism is known from European Publication No. 0 242 712-A2. Within such a timepiece casing, but outside the structure of the electro-mechanical mechanism is located the ferrite rod of a magnetic long wave antenna. The antenna is connected by means of a flexible twin-core cable to the permanently tuned receiver for the demodulation of binary coded signals. Those time signals supply instantaneous absolute time information whereby the display of time, for example the setting of the hands of an electro-mechanical analog display, may be monitored and potentially corrected, as described in more detail for example in Allgaier et al U.S. Pat. No. 4,645,357.

In the case of very small radio timepieces, such as for example radio-controlled wristwatches, it is known from DE-GM 88 15 967, to locate the magnetic long wave antenna not only outside the mechanism, but even outside the watch case housing, i.e., in the watch band articulated onto the case. This obviously restricts the freedom of the designer designing the watch band.

Such restrictions also apply to wristwatches wherein the outer casing is made of ferrite and defines the antenna core as disclosed in European Publication No. 0 382 130-A2. In particular, as the result of such an arrangement, the configuration of the wristwatch casing becomes more complex, and safe electrical connections between the core defined by the casing and a circuit located in the casing are very difficult and expensive.

In view of these conditions, it is an object of the invention to provide a small radio timepiece, in particular in the form of a wristwatch, wherein creative freedom is preserved and connection complications are avoided.

SUMMARY OF THE PREFERRED EMBODIMENT OF THE INVENTION

This object is attained according to the invention by a radio timepiece having an outer casing for containing clockworks components, including a time display, an antenna for receiving radio signals to control the time display, and a receiver interconnecting the antenna and time display. The time display further comprises a ferrite plate disposed in the casing for carrying clockworks components. The time display is mounted on the plate. The plate includes a constriction, and the antenna includes an antenna coil disposed in that constriction such that the ferrite plate constitutes a core for the antenna coil.

Thus, the ferrite plate itself serves as the base plate, the circuit support and the antenna coil former, thereby already representing a fully functional timepiece mechanism, which in the course of its installation in a watch case formed of an electrically non-shielding material, needs only to be connected with a power source (e.g., primary battery or electro-chemical or electro-physical storage means for buffering in the case of an operation with solar cells). In the design of the watch mechanism itself there is no longer any need to take into consideration the connection of an external antenna or an antenna mounted on the case, as the antenna is now an integral part of the mechanism. Also, no separate circuit board is needed.

In the interest of high antenna gain, the volume of the ferrite plate limited by the dimensions of the bottom plate is hollowed out only to the extent that it is necessary for the support of upstanding components to be applied, such as the gear works with the drive motor, a time-keeping vibrating quartz and optionally an antenna circuit smoothing capacitor.

Flat components, such as liquid crystal displays and non-encapsulated integrated circuits (transparencies) are adhesively bonded directly to the bottom plate without the insertion of a circuit board, i.e., mounted (glued) onto the ferrite surface and connected by means of advanced connecting methods, such as for example Flip-Chip bonding with the strip conductors. The latter are applied directly to the ferrite surface (if necessary with the insertion of an insulating layer) by thick or thin layer techniques, thereby forming a three-dimensional strip conductor network, as it were, whereby they follow the profile of the base plate to connect the works motor to the antenna. The recesses for the thicker components may be ground into the hard, plate-shaped ferrite plate with the necessary precision, especially relative to the mounting of the wheels of the hands mechanism. Alternatively, a coarse contour may be produced by a powder metallurgical injection molding process and made accurate by a subsequent grinding process, or else thin injection molded plastic precision inserts may be inserted.

The constriction acting as the coil former may be eccentrically offset relative to the recess of the hands mechanism on opposing lateral edges, thereby producing a field axis disposed parallel to the principal plane of the base plate and consequently the high directional receiving sensitivity of a magnetic dipole. If, on the other hand, the constriction is extending instead along the edge of the base plate, a particularly short and therefore especially direction insensitive magnetic antenna is created, as then the coil axis is oriented perpendicularly to the principal plane of the base plate.

BRIEF DESCRIPTION OF THE DRAWING

The objects and advantages of the invention will become apparent from the following detailed description of a preferred embodiment thereof, in which like numerals designate like elements and in which.

DETAILED DESCRIPTION OF A PREFERRED EMBODIMENT OF THE INVENTION

Figure 2:
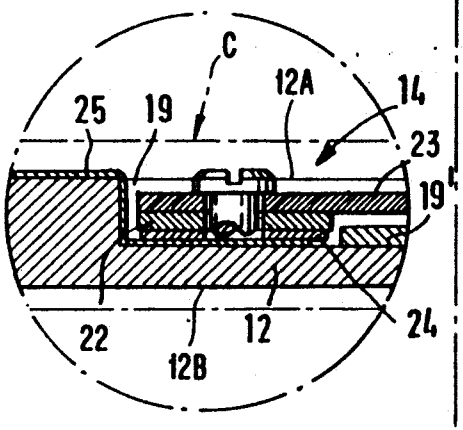
FIG. 2 is a cross-sectional view taken along line 2—2 of FIG. 1.

The mechanism 11 depicted in the drawing is intended for installation in a small watch case C, preferably a wristwatch case. The mechanism 11 mainly comprises a base plate 12 to hold a time display hands mechanism 13 and its motor 14, together with at least one timekeeping circuit 15 having a vibration stabilizing quartz 16. The base plates includes first and second side surfaces 12A, 12B, and a plurality of edge surfaces 12C extending between the side surfaces and defining a thickness of the plate. In addition to, or in lieu of, the hands mechanism 13 the base plate 12 may support an opto-electronic time display 31, which may be operated by means of a decoder 17 from the circuit 15 through a serial bus 18 in order to minimize the cost of the production of the strip conductors on the base plate. Journal-supported wheels of the hands mechanism are equipped at the bottom of a gear recess 19 and are held therein by a bridge in the form of a perforated plate 20. The plate is mounted over the recess 19 and is attached by screws to the base plate 12. This plate 20 also positions in the recess 19 the motor 14 and its coil 21, which is resting on a coil holder 23 that is screwed to the stator plate 22. The holder 23 is contacted by connecting tabs 24 (FIG. 2) with two strip conductors 25. In FIG. 2, it is shown that a precision injection molded insert 19' may be affixed at the bottom of the recess 19. The insert has blind holes for connection with the wheel shafts. The insert avoids the need for dimensionally correct machining of the bottom of the recess 19 to form the blind holes.

Importantly, the base plate 12 comprises an extended rectangular solid plate formed of a mechanically hard but magnetically soft ferrite, in which are formed recesses 19, 19A, 19B for only taller components, such as the hands mechanism 13, the motor 14, the quartz 16, and an optional capacitor 29. This maintains the magnetically effective ferrite mass as large as possible in view of the given surface area and thickness of the base plate 12. On the other hand, components that are shorter, such as the integrated circuit 15 or the optronic display 31 with its decoder 17, together with the strip conductors 25 and optionally a solar cell 26, are bonded or laminated flat onto the ferrite plate, with the insertion of an electrically insulating layer or an electrically conducting surface, if necessary.

This ferrite base plate 12 serves as the core of an antenna coil 27, wound eccentrically relative to the plate 12 around a constriction 28 acting as the coil former. The antenna thus extends across the side surfaces 12A, 12B. The axis of the antenna coil 27 extends transversely to the axes of the hand shafts and thus parallel to the principal plane of the base plate 12, which may have dimensions for example on the order of magnitude of $30 \times 25 \times 3$ mm (i.e., length, width, and thickness). The plate 12 is weakened in arbitrary cross-sectional planes oriented transversely to the axis of the antenna coil 27 by the recesses 19, 19A, 19B, which weakening of the magnetic strength of the plate 12 is no greater than 50% of its strength. Such a ferrite work plate 12 corresponds, with reference to its antenna gain, to a conventional ferrite rod antenna of an approximate length of 30 mm and a diameter of 7 mm. Experience has shown that with an antenna of this order of magnitude, good radio reception results have been achieved.

Figure 1:
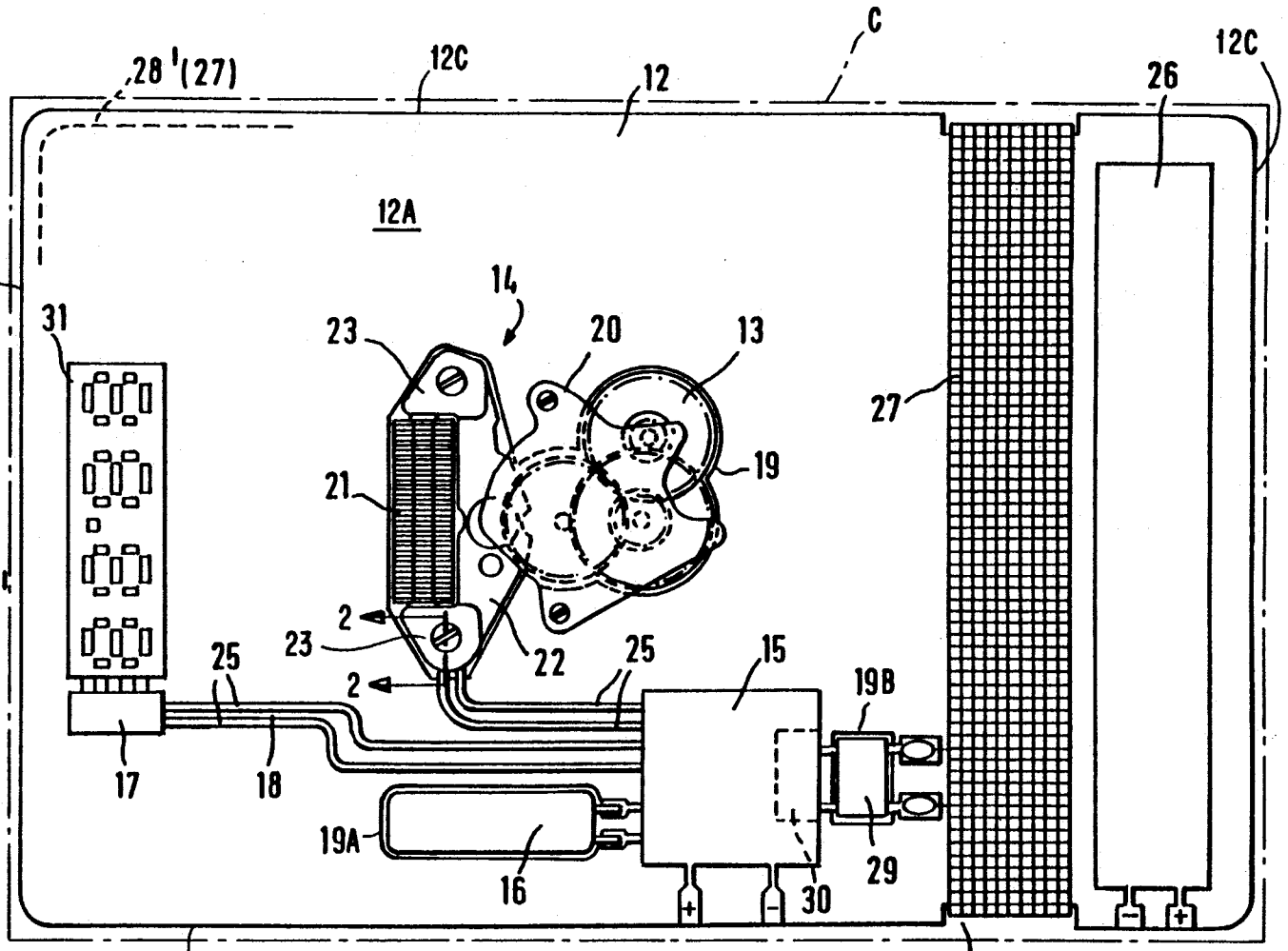
FIG. 1 is a top plan view of a base plate according to the invention equipped for a wrist watch with a hybrid time display.

Alternatively, an antenna-receiving constriction 28' could extend along the edge of the ferrite plate 12 (as shown in FIG. 1), so that the antenna extends around that edge and the axis of the antenna coil 27 is oriented transverse to the principal plane of the bottom plate 12 and thus parallel to the axes of the hands. Consequently, the effect of an extremely short magnetic antenna is obtained, the antenna gain of which is reduced, but which has the advantage of the extended geometry of the base plate 12 acting as an antenna rod of better circular receiving sensitivity as compared to the dipole character of an antenna ferrite rod.

The antenna coil 27 is connected to a long wave receiver 30. The coil 27 can be optionally connected in parallel with the capacitor 29, i.e., a smoothing capacitor 29 which is connected to the long wave receiver 30. The receiver 30 can comprise a separate, integrated circuit which is connect to the long wave receiver 30. The receiver 30 can comprise a separate, integrated circuit mounted on the surface of the base plate 12, or according to FIG. 1, it may be included in a complex integrated circuit 15 for the evaluation of the demodulated information received and for the control of the time display.

The recesses 19, 19A, 19B can be ground into a solid plate 12, or the plate 12 could be molded to simultaneously form the recesses, e.g., by powder metallurgical injection molding.

Although the present invention has been described in connection with a preferred embodiment thereof, it will be appreciated by those skilled in the art that additions, modifications, substitutions, and deletions not specifically described may be made without departing from the spirit and scope of the invention as defined in the appended claims.

What is claimed is:

1. In a radio controlled timepiece having an outer casing for containing clockworks components, including a time display, an antenna for receiving radio signals to control said time display, and a receiver interconnecting said antenna and said time display, said timepiece further comprising a ferrite plate disposed within said outer casing and including at least one recess for receiving a clockworks component, said plate including antenna-receiving means for receiving said antenna, said antenna comprising an antenna coil disposed in said antenna-receiving means such that said ferrite plate constitutes a core for said antenna coil.

2. A radio controlled timepiece according to claim 1, wherein said antenna-receiving means comprises a constriction in said plate.

3. A radio controlled timepiece according to claim 1, wherein said plate comprises first and second side surfaces interconnected by edge surfaces which define a thickness of said plate, said at least one recess formed in one of said side surfaces.

4. A radio controlled timepiece according to claim 3, wherein said antenna coil extends across said first and second side surfaces.

5. A radio controlled timepiece according to claim 3, wherein said antenna coil extends around said edge surfaces.

6. A radio controlled timepiece according to claim 3 including an insert affixed in the bottom of said recess, said insert including a hole to which said operating component is connected.

7. A radio controlled timepiece according to claim 1, wherein said clockworks component comprises a vibration stabilizing quartz.

8. A radio controlled timepiece according to claim 1, wherein said clockworks component comprises a hands mechanism and a motor therefor.

9. A radio controlled timepiece according to claim 8 including a ferrite disk overlying said hands mechanism and motor for retaining said hands mechanism and said motor in said at least one recess.

10. A radio controlled timepiece according to claim 1 including at least one flat clockworks component mounted on said one side surface.

11. A radio controlled timepiece according to claim 1 including electrical strip conductors applied to said one side surface and connected to said at least one recess and connected to said clockworks component.

12. In a radio controlled timepiece having an outer casing for containing clockworks components, including a time display, an antenna for receiving radio signals to control said time display, and a receiver interconnecting said antenna and said time display, said timepiece further comprising a ferrite plate disposed in said casing for carrying clockworks components, said time display being mounted on said plate, said plate including antenna-receiving means for receiving said antenna, said antenna including an antenna coil disposed in said antenna-receiving means such that said ferrite plate constitutes a core for said antenna coil.

13. Apparatus according to claim 12, wherein said antenna-receiving means comprises a constriction formed in said plate.

* * * * *